US010550454B2

(12) United States Patent
Ta et al.

(10) Patent No.: US 10,550,454 B2
(45) Date of Patent: Feb. 4, 2020

(54) COLD-ROLLED FERRITIC STAINLESS STEEL SHEET

(71) Applicant: JFE STEEL CORPORATION, Tokyo (JP)

(72) Inventors: Ayako Ta, Chiba (JP); Yukihiro Matsubara, Kurashiki (JP); Yukio Kimura, Fukuyama (JP); Keisuke Nakazono, Chiba (JP); Masataka Yoshino, Chiba (JP)

(73) Assignee: JFE Steel Corporation, Tokyo (JP)

( * ) Notice: Subject to any disclaimer, the term of this patent is extended or adjusted under 35 U.S.C. 154(b) by 317 days.

(21) Appl. No.: 15/508,362

(22) PCT Filed: Jul. 2, 2015

(86) PCT No.: PCT/JP2015/003344

§ 371 (c)(1),
(2) Date: Mar. 2, 2017

(87) PCT Pub. No.: WO2016/035236

PCT Pub. Date: Mar. 10, 2016

(65) Prior Publication Data

US 2017/0283923 A1 Oct. 5, 2017

(30) Foreign Application Priority Data

Sep. 5, 2014 (JP) ..... 2014-181023

(51) Int. Cl.

| | |
|---|---|
| ***C22C 38/54*** | (2006.01) |
| ***C21D 9/46*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |

(52) U.S. Cl.

CPC ..... *C22C 38/54* (2013.01); *C21D 8/0226* (2013.01); *C21D 8/0236* (2013.01); *C21D 8/0273* (2013.01); *C21D 9/46* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C21D 2211/005* (2013.01)

(58) Field of Classification Search

CPC ..... C21D 2211/005; C21D 8/0226; C21D 8/0236; C21D 8/0273; C21D 9/46; C22C 38/00; C22C 38/001; C22C 38/002; C22C 38/005; C22C 38/02; C22C 38/04; C22C 38/06; C22C 38/18; C22C 38/42; C22C 38/44; C22C 38/46; C22C 38/48; C22C 38/50; C22C 38/52; C22C 38/54

See application file for complete search history.

(56) References Cited

U.S. PATENT DOCUMENTS

| | | | | |
|---|---|---|---|---|
| 2001/0003293 | A1 | 6/2001 | Hirata et al. | |
| 2002/0074067 | A1 * | 6/2002 | Ota ..... | C21D 8/0205 148/610 |
| 2004/0055673 | A1 | 3/2004 | Kimura et al. | |

FOREIGN PATENT DOCUMENTS

| | | | | |
|---|---|---|---|---|
| CN | 101671796 | A | | 3/2010 |
| EP | 1099773 | A1 | | 5/2001 |
| EP | 1308532 | A2 | | 5/2003 |
| EP | 1734143 | A1 | | 12/2006 |
| EP | 2722411 | A1 | | 4/2014 |
| JP | H08225852 | A | | 9/1996 |
| JP | H09111354 | A | | 4/1997 |
| JP | 2000102802 | A | | 4/2000 |
| JP | 2003231954 | A | | 8/2003 |
| JP | 2004197197 | A | * | 7/2004 |
| JP | 2004197197 | A | | 7/2004 |
| JP | 2004223536 | A | | 8/2004 |
| JP | 2007119849 | A | | 5/2007 |
| JP | 2007119849 | A | * | 5/2007 |
| JP | 201095742 | A | | 4/2010 |
| JP | 2010095742 | A | * | 4/2010 |
| JP | 2010095742 | A | | 4/2010 |
| JP | 2011256440 | A | | 12/2011 |
| KR | 20060007441 | A | | 1/2006 |
| TW | 201307582 | A | | 2/2013 |

OTHER PUBLICATIONS

International Search Report and Written Opinion for International Application No. PCT/JP2015/003344, dated Aug. 4, 2015, 5 Pages.
Taiwanese Office Action for Taiwanese Application No. 104122007, dated Mar. 1, 2016, with Concise Statement of Relevance of Office Action, 4 pages.

(Continued)

*Primary Examiner* — Jenny R Wu
(74) *Attorney, Agent, or Firm* — RatnerPrestia

(57) ABSTRACT

Provided is a cold-rolled ferritic stainless steel sheet having a chemical composition that contains, by mass %, C: 0.01% or more and 0.05% or less, Si: 0.02% or more and 0.75% or less, Mn: 0.1% or more and 1.0% or less, P: 0.04% or less, S: 0.01% or less, Al: 0.001% or more and 0.10% or less, N: 0.01% or more and 0.06% or less, Cr: 16.0% or more and 18.0% or less, and the balance being Fe and inevitable impurities. The metallographic structure includes a ferrite phase, in which the average grain diameter is 10 μm or less, in which the proportion of ferrite grains having a grain diameter of 10 μm or more and less than 40 μm is 60% or more, and in which the proportion of ferrite grains having a grain diameter of less than 5 μm is less than 20%.

4 Claims, No Drawings

(56) References Cited

OTHER PUBLICATIONS

Chinese Office Action for Chinese Application No. 201580047158.7, dated Oct. 30 2017 with Concise Statement of Relevance, 8 pages.
Extended European Search Report for European Application No. 15837725.9, dated Jan. 2, 2018, 9 pages.
Grant of Patent for Korean Application No. 10-2017-7006039, dated Nov. 13, 2018; with translation, 2 pages.
Korean Office Action for Korean Application No. 10-2017-7006039, dated Jun. 21, 2018, with Concise Statement of Relevance of Office Action, 5 pages.

* cited by examiner

COLD-ROLLED FERRITIC STAINLESS STEEL SHEET

CROSS REFERENCE TO RELATED APPLICATIONS

This application is the U.S. National Phase application of PCT International Application No. PCT/JP2015/003344, filed Jul. 2, 2015, and claims priority to Japanese Patent Application No. 2014-181023, filed Sep. 5, 2014, the disclosures of each of these applications being incorporated herein by reference in their entireties for all purposes.

FIELD OF THE INVENTION

The present invention relates to a cold-rolled ferritic stainless steel sheet which has good formability (elongation and r value) and which is excellent in terms of surface appearance quality (roping resistance, surface gloss, ridging resistance, and surface roughening resistance).

BACKGROUND OF THE INVENTION

A cold-rolled ferritic stainless steel sheet, which is economical and excellent in terms of corrosion resistance, is used in various applications such as building materials, transportation instruments, home electrical appliances, kitchen equipment, chemical plants, water storage tanks, and automobile parts, and the range of its application has been expanding in recent years. In order to be used in these applications, such a cold-rolled steel sheet is required to have not only sufficient corrosion resistance but also sufficient formability (such as elongation and average Lankford value (hereinafter, also referred to as "average r value")) which allows steel to be formed into a desired shape, and is required to be excellent in terms of surface appearance quality before and after a forming work process.

Conventionally, it is known that irregularities called "ridging", which has a concave-convex shape parallel to the rolling direction, and irregularities called "surface roughening (orange peel)", which is caused by undulation of crystal grains, are generated in a cold-rolled ferritic stainless steel sheet in a forming work process. Since such kinds of irregularities deteriorate surface appearance quality, such kinds of irregularities are removed in a following polishing process, and it is thereby preferable that the amount of such kinds of irregularities generated be as small as possible to reduce the polishing load.

In addition, since a stainless steel sheet, which is excellent in terms of corrosion resistance, is used without being subjected to coating or painting in many cases, its own appearance is also important. Specifically, since visual surface appearance such as surface gloss and the clarity of a reflected image influence buying intention, it is important to improve visual surface appearance. It is known that the visual surface appearance of a product depends on the smoothness of a surface and the existence of surface defects. Since waviness called "roping", which is parallel to the rolling direction, deteriorates the clarity of a reflected image, and since rolling-induced surface defects typified by, for example, a dent flaw called "oil pit", which is occurred on the surface of sheet during cold rolling by lubricant that drawn into roll-bite, and flaws generated by the transfer of the polishing marks of work rolls cause white and cloudy surface appearance, there is a decrease in commercial value. Therefore, it is required to achieve a smooth surface so that the surface becomes as close as possible to a mirror surface by inhibiting the waviness and the surface defects from occurring.

In response to such requirements, Patent Literature 1 discloses a method for manufacturing a cold-rolled stainless steel sheet, the method including heating a steel slab having a chemical composition containing, by mass %, C: 0.01% to 0.03%, Si: 0.02% to 0.030%, Mn 0.45% to 1.0%, P: 0.05% or less, S: 0.01% or less, Al: 0.01% to 0.20%, N: 0.01% to 0.06%, Cr: 16.0% to 18.0%, and the balance being Fe and inevitable impurities, to a temperature higher than 1050° C., performing hot rolling on the heated steel slab with a finishing delivery temperature of 800° C. to 1000° C., performing pickling, then performing cold rolling, holding the cold-rolled steel sheet at a temperature of 800° C. to 950° C. for 20 seconds, and then cooling the held steel sheet at a cooling rate of 10° C./s or more. Patent Literature 1 states that, with this, it is possible to obtain a cold-rolled ferritic stainless steel sheet having a metallographic structure, in which the proportion of a ferrite phase to the whole metallographic structure is 80% to 97% in terms of area ratio, and in which the average grain diameter of a ferrite phase is 5 μm to 20 μm, and a good strength-elongation balance corresponding to a TS×El of 15000 MPa·% or more, and being capable of decreasing the amount of ridging generated in a forming process. That is, in the technique according to Patent Literature 1, long-time annealing performed on a hot-rolled steel sheet is omitted, and the conditions of cold-rolled-sheet annealing and cooling are specified. However, in the case of the technique disclosed in Patent Literature 1, since long-time hot-rolled-sheet annealing is omitted, cold rolling is performed on a hardened hot-rolled steel sheet, which results in a significant deterioration in manufacturability in a cold rolling process.

In addition, Patent Literature 2 discloses a technique for increasing ridging resistance in which the chemical composition contains, by mass %, C: 0.02% or less, Si: 0.70% or less, Mn: 0.50% or less, P: 0.04% or less, S: 0.01% or less, Al: 0.01% to 0.15%, N: 0.02% or less, Cr: 16% to 23%, Ni: 0.50% or less, Ti: 0.10% or less, Nb: 0.01% or less, and Zr: 0.20% to 0.80%, and in which the effect of preventing a grain diameter from increasing as a result of Zr fixing C and N in the form of precipitates is utilized in order to control the average grain diameter of ferrite grains after a finish annealing process to be 15 μm or less. However, although the grain diameter is successfully controlled to be 15 μm or less through the effect of Zr, since a certain amount of Zr is contained, there is a problem of an increase in manufacturing costs, and there is a problem of a significant deterioration in formability, in particular, elongation after fracture due to a significant increase in yield strength through the pinning effect of Zr-based carbonitrides, since precipitation of Zr-based carbonitrides is utilized for inhibiting an increase in grain diameter.

Moreover, Patent Literature 3 discloses a technique in which gloss is improved by decreasing the amount of oil drawn into a roll bite in order to inhibit oil pits from occurring and, at the same time, by suppressing the transfer of concave-convex patterns on the surfaces of rolls as a result of using hard low-surface-roughness work rolls in a cold rolling process. However, while there is a certain effect of removing rolling-induced surface defects, it is not possible to solve a problem of surface defects due to a raw material such as roping, ridging, and surface roughening, and there is an increase in roll operational costs due to an increase in polishing load.

PATENT LITERATURE

PTL 1: Japanese Unexamined Patent Application Publication No. 2010-95742

PTL 2: Japanese Unexamined Patent Application Publication No. 2011-256440

PTL 3: Japanese Unexamined Patent Application Publication No. 2000-102802

SUMMARY OF THE INVENTION

An object of aspects of the present invention is, by solving the problems described above, to provide a cold-rolled ferritic stainless steel sheet excellent in terms of surface appearance quality before and after a forming process and having sufficient formability.

Here, in accordance with aspects of the present invention, the term "excellent in terms of surface appearance quality before and after a forming process" refers to a case excellent in terms of surface gloss and roping resistance before a forming work process and in terms of ridging resistance and surface roughening resistance after a forming work process.

The term "excellent in terms of surface gloss before a forming work process" refers to a case where, when determining glossiness of a test piece taken from the central portion in the width direction of a steel sheet at two points each in directions at angles of 0° and 90° to the rolling direction by using the reflected energy (Gs20°) of a light having an incidence angle of 20° in accordance with the prescription in JIS Z 8741, the average value of the determined values is 950 or more.

The term "excellent in terms of roping resistance" refers to a case where, when determining surface roughness in a direction at an angle of 90° to the rolling direction in accordance with JIS B 0601-2001, Rz is 0.2 μm or less.

The term "excellent in terms of ridging resistance" refers to a case where, after taking a JIS No. 5 tensile test piece from the central portion in the width direction of a steel sheet so that the tensile direction is at an angle of 0° to the rolling direction, then polishing one side of the test piece to #600 finish, and then giving a pre-strain of 20% to the test piece by performing a uniaxial tensile test in accordance with JIS Z 2241, when determining waviness height in the polished surface in the middle of the parallel part of the test piece in accordance with JIS B 0601-2001, large waviness (ridging height) is 2.5 μm or less.

The term "excellent in terms of surface roughening resistance" refers to a case where, when determining surface roughness in the polished surface in the middle of the parallel part of the test piece used for determining ridging resistance in accordance with JIS B 0601-2001, Ra is less than 0.2 μm.

In addition, the term "sufficient formability" refers to a case of sufficient elongation and a sufficient average r value. A tensile test is performed on JIS No. 13B test pieces respectively having tensile directions at angles of 0°, 45°, and 90° to the rolling direction in accordance with JIS Z 2241. The term "sufficient formability" refers to a case where an average r value, which is derived by using equation (1) from r values obtained when a pre-strain of 15% is given, is 0.65 or more and where, when performing an ordinary tensile test, elongation after fracture in a direction at an angle of 90° to the rolling direction is 25% or more.

$$r_{ave}=(r_0+r_{90}+2\times r_{45})/4 \quad (1)$$

Here, "$r_{ave}$" denotes an average r value, "$r_0$" denotes an r value in a direction parallel to the rolling direction, "$r_{90}$" denotes an r value in a direction at a right angle to the rolling direction, and "$r_{45}$" denotes an r value in a direction at an angle of 45° to the rolling direction.

From the results of investigations conducted for solving the problems, the followings were found.

By controlling the grain diameter of a ferrite phase after a cold-rolled-sheet annealing process to be within a small grain diameter range corresponding to an average grain diameter of 10 μm or less, it is possible to prevent ridging, roping, and surface roughening, which are caused by anisotropy in the deformation capability of a raw material such as irregularities due to crystal grains or colonies. In order to control the average grain diameter of a ferrite phase after a cold-rolled-sheet annealing process to be 10 μm or less, it is necessary to increase the number of recrystallization sites in a cold-rolled-sheet annealing process by generating a large amount of dislocations before a cold-rolled-sheet annealing process. That is, in accordance with aspects of the present invention, instead of using Zr carbonitrides which is disclosed in Patent Literature 1, by generating a large amount of dislocations through the utilization of rolling work or a martensite phase described below, the average grain diameter of a ferrite phase after a cold-rolled-sheet annealing process is successfully controlled to be 10 μm or less. Although there is an increase in the hardness of metal due to an increase in the amount of dislocations, in accordance with aspects of the present invention, by utilizing such a hard metallographic structure in order to decrease the deformation capability of the surface before a cold-rolled-sheet annealing process, it is possible to achieve high-glossiness surface with less rolling-induced defects.

Moreover, since average grain diameter and grain diameter distribution is controlled appropriately by mixing fine ferrite grains having a diameter of several μm in a metallographic structure which consists mostly of ferrite grains, whose recrystallization and grain growth have progressed, it is also possible to achieve sufficient formability such as elongation and an average r value.

Aspects of the present invention have been completed on the basis of the findings described above, and the subject matter of aspects of the present invention is as follows.

[1] A cold-rolled ferritic stainless steel sheet having a chemical composition containing, by mass %, C: 0.005% or more and 0.05% or less, Si: 0.02% or more and 0.75% or less, Mn: 0.1% or more and 1.0% or less, P: 0.04% or less, S: 0.01% or less, Al: 0.001% or more and 0.10% or less, N: 0.005% or more and 0.06% or less, Cr: 16.0% or more and 18.0% or less, and the balance being Fe and inevitable impurities and a metallographic structure including a ferrite phase, in which the average grain diameter of a ferrite phase is 10 μm or less, in which the proportion of ferrite grains having a grain diameter of 10 μm or more and less than 40 μm to the whole metallographic structure is 60% or more in terms of area ratio, and in which the proportion of ferrite grains having a grain diameter of less than 5 μm to the whole metallographic structure is less than 20% in terms of area ratio.

[2] The cold-rolled ferritic stainless steel sheet according to item [1] above, the chemical composition further containing, by mass %, one, two, or more selected from among Cu: 0.1% or more and 1.0% or less, Ni: 0.1% or more and 1.0% or less, Mo: 0.1% or more and 0.5% or less, and Co: 0.01% or more and 0.3% or less.

[3] The cold-rolled ferritic stainless steel sheet according to item [1] or [2] above, the chemical composition further containing, by mass %, one, two, or more selected from among V: 0.01% or more and 0.25% or less, Ti: 0.001% or more and 0.015% or less, Nb: 0.001% or more and 0.030% or less, Mg: 0.0002% or more and 0.0050% or less, B: 0.0002% or more and 0.0050% or less, and REM: 0.01% or more and 0.10% or less.

Here, in the present description, % used when describing the chemical composition of steel shall always refer to mass %.

According to aspects of the present invention, it is possible to obtain a cold-rolled ferritic stainless steel sheet excellent in terms of aesthetic surface appearance quality before and after a forming process and having sufficient formability.

DETAILED DESCRIPTION OF EMBODIMENTS OF THE INVENTION

Embodiments of the present invention will be described in detail hereafter.

The cold-rolled ferritic stainless steel sheet according to aspects of the present invention has a chemical composition containing, by mass %, C: 0.005% or more and 0.05% or less, Si: 0.02% or more and 0.75% or less, Mn: 0.1% or more and 1.0% or less, P: 0.04% or less, S: 0.01% or less, Al: 0.001% or more and 0.10% or less, N: 0.005% or more and 0.06% or less, Cr: 16.0% or more and 18.0% or less, and the balance being Fe and inevitable impurities. The metallographic structure includes a ferrite phase, in which the average grain diameter of a ferrite phase is 10 μm or less, in which the proportion of ferrite grains having a grain diameter of 10 μm or more and less than 40 μm to the whole metallographic structure is 60% or more in terms of area ratio, and in which the proportion of ferrite grains having a grain diameter of less than 5 μm to the whole metallographic structure is less than 20% in terms of area ratio. These conditions are important requirements of aspects of the present invention, and specifying the grain diameter of a ferrite phase and the amounts of the grains is a particularly important requirement. By using such a cold-rolled stainless steel sheet, it is possible to obtain a cold-rolled ferritic stainless steel sheet having sufficient formability and excellent in terms of surface gloss, roping resistance, ridging resistance, and surface roughening resistance, that is, excellent in terms of surface appearance quality before and after a forming process.

Here, the term "the grain diameter of a ferrite phase" in accordance with aspects of the present invention refers to a value calculated to be equal to (distance between grain boundaries in a direction parallel to the rolling direction+distance between grain boundaries in the thickness direction)/2 for ferrite grains in a metallographic structure exposed in a cross section parallel to the rolling direction.

Hereafter, the chemical composition of the cold-rolled ferritic stainless steel sheet according to aspects of the present invention will be described.

Hereinafter, % refers to mass %, unless otherwise noted.

C: 0.005% or more and 0.05% or less

C is effective for promoting the formation of an austenite phase and expanding a dual-phase temperature range in which a ferrite phase and an austenite phase are formed in a hot-rolled-sheet annealing process. In order to obtain such an effect, it is necessary that the C content be 0.005% or more. In addition, in the case where the C content is less than 0.005%, since the progress of recrystallization and grain growth is excessively promoted due to a decrease in the amount of a solid solute C and/or a decrease in the amount of carbides precipitated, there is an increase in the average grain diameter of ferrite, which makes it impossible to satisfy the condition of aspects of the present invention that the average grain diameter of ferrite is 10 μm or less. However, in the case where the C content is more than 0.05%, there is a deterioration in ductility due to an increase in the hardness of a steel sheet. In addition, in the case where the C content is more than 0.05%, since there is an increase in the amount of martensite formed in a hot-rolled-sheet annealing process, there is a deterioration in manufacturability due to an increase in rolling load in a cold rolling process. In addition, since there is an increase in the amount of a fine ferrite phase formed through the decomposition of martensite in a cold-rolled-sheet annealing process due to an increase in the amount of martensite existing before a cold-rolled-sheet annealing process, there is a decrease in the area ratio of ferrite grains having a grain diameter of 10 μm or more and less than 40 μm due to an increase in the area ratio of ferrite grains having a grain diameter of less than 5 μm which is specified in accordance with aspects of the present invention, which makes it impossible to achieve the desired material properties. Therefore, the C content is set to be 0.0050 or more and 0.05% or less, preferably 0.01% or more and 0.03% or less, or more preferably 0.015% or more and 0.02% or less. The term "C content" refers to the amount of C contained, and the same goes for other constituent chemical elements.

Si: 0.02% or more and 0.75% or less

Si is a chemical element which functions as a deoxidizing agent in the process of preparing molten steel. In order to obtain such an effect, it is necessary that the Si content be 0.02% or more. However, in the case where the Si content is more than 0.75%, since there is an increase in the hardness of a steel sheet, there is an increase in rolling load in a hot rolling process, and there is a deterioration in ductility after a cold-rolled-sheet annealing process. Therefore, the Si content is set to be 0.02% or more and 0.75% or less, preferably 0.10% or more and 0.50% or less, or more preferably 0.15% or more and 0.35% or less.

Mn: 0.1% or more and 1.0% or less

Mn is, like C, effective for expanding a dual-phase temperature range in which a ferrite phase and an austenite phase are formed in a hot-rolled-sheet annealing process as a result of promoting the formation of an austenite phase. In order to obtain such an effect, it is necessary that the Mn content be 0.1% or more. However, in the case where the Mn content is more than 1.0%, there is a deterioration in corrosion resistance due to an increase in the amount of MnS formed. Therefore, the Mn content is set to be 0.1% or more and 1.0% or less, preferably 0.55% or more and 0.90% or less, or more preferably 0.65% or more and 0.85% or less.

P: 0.04% or less

Since P is a chemical element which promotes intergranular fracturing due to intergranular segregation, it is preferable that the P content be as small as possible, and the upper limit of the P content is set to be 0.04%, or preferably 0.03% or less.

S: 0.01% or less

S is a chemical element which deteriorates, for example, ductility and corrosion resistance as a result of existing in the form of sulfide-based inclusions such as MnS, and such harmful effects become marked, in particular, in the case where the S content is more than 0.01%. Therefore, it is desirable that the S content be as small as possible, and the upper limit of the S content is set to be 0.01%, preferably 0.007% or less, or more preferably 0.005% or less, in aspects of the present invention.

Al: 0.001% or more and 0.10% or less

Al is, like Si, a chemical element which functions as a deoxidizing agent. In order to obtain such an effect, it is necessary that the Al content be 0.001% or more. However, in the case where the Al content is more than 0.10%, since there is an increase in the amount of Al-based inclusions such as $Al_2O_3$, there is a tendency for surface quality to be deteriorated. Therefore, the Al content is set to be 0.001% or more and 0.10% or less, preferably 0.001% or more and 0.07% or less, or more preferably 0.001% or more and 0.01% or less.

N: 0.005% or more and 0.06% or less

N is, like C and Mn, effective for expanding a dual-phase temperature range in which a ferrite phase and an austenite phase are formed in a hot-rolled-sheet annealing process as a result of promoting the formation of an austenite phase. In order to obtain such an effect, it is necessary that the N content be 0.005% or more. However, in the case where the N content is more than 0.06%, there is a significant deterioration in ductility, and there is a deterioration in corrosion resistance as a result of promoting the precipitation of Cr nitrides. Therefore, the N content is set to be 0.005% or more and 0.06% or less, preferably 0.01% or more and 0.03% or less, or more preferably 0.01% or more and 0.02% or less.

Cr: 16.0% or more and 18.0% or less

Cr is a chemical element which is effective for improving corrosion resistance by forming a passivation film on the surface of a steel sheet. In order to obtain such an effect, it is necessary that the Cr content be 16.0% or more. In addition, in the case where the Cr content is less than 16.0%, since recrystallization and grain growth are excessively promoted, there is an increase in the average grain diameter of ferrite, which makes it impossible to satisfy the condition of aspects of the present invention that the average grain diameter of ferrite is 10 μm or less. On the other hand, in the case where the Cr content is more than 18.0%, since there is an insufficient amount of fine ferrite grains formed through decomposing by martensite transformation in a cold-rolled-sheet annealing process due to an insufficient amount of an austenite phase (which transforms into a martensite phase in the cooling process of a hot-rolled-sheet annealing process) formed in a hot-rolled-sheet annealing process, there is a decrease in the area ratio of ferrite grains having an average grain diameter of 10 μm or more and less than 40 μm which is specified in accordance with aspects of the present invention, which makes it impossible to achieve the desired material properties. Therefore, the Cr content is set to be 18.0% or less, preferably 16.0% or more and 17.5% or less, or more preferably 16.5% or more and 17.0% or less.

The remainder is Fe and inevitable impurities.

With the chemical composition described above, effects of aspects of the present invention are obtained. Moreover, the following chemical elements may be contained in order to improve manufacturability or material properties.

One, two, or more selected from among Cu: 0.1% or more and 1.0% or less, Ni: 0.1% or more and 1.0% or less, Mo: 0.1% or more and 0.5% or less, and Co: 0.01% or more and 0.3% or less Cu and Ni are both chemical elements which increase corrosion resistance, and containing Cu and/or Ni is effective, in particular, in the case where high corrosion resistance is required. In addition, Cu and Ni are effective for expanding a dual-phase temperature range in which a ferrite phase and an austenite phase are formed in a hot-rolled-sheet annealing process as a result of promoting the formation of an austenite phase. Such effects become marked in the case where the content of each of these chemical elements is 0.1% or more. However, it is not preferable that the Cu content be more than 1.0%, because there may be a deterioration in hot workability. Therefore, in the case where Cu is contained, the Cu content is set to be 0.1% or more and 1.0% or less, preferably 0.1% or more and 0.6% or less, or more preferably 0.3% or more and 0.5% or less. It is not preferable that the Ni content be more than 1.0%, because there may be a deterioration in workability. Therefore, in the case where Ni is contained, the Ni content is set to be 0.1% or more and 1.0% or less, preferably 0.1% or more and 0.6% or less, or more preferably 0.1% or more and 0.3% or less.

Mo is a chemical element which improves corrosion resistance, and containing Mo is effective, in particular, in the case where high corrosion resistance is required. Such an effect becomes marked in the case where the Mo content is 0.1% or more. However, it is not preferable that the Mo content be more than 0.5%, because, since there is an insufficient amount of austenite phase formed in a hot-rolled-sheet annealing process, there is a case where it is not possible to achieve the specified material properties. Therefore, in the case where Mo is contained, the Mo content is set to be 0.1% or more and 0.5% or less, or preferably 0.2% or more and 0.4% or less.

Co is a chemical element which improves toughness. Such an effect is obtained in the case where the Co content is 0.01% or more. On the other hand, in the case where the Co content is more than 0.3%, there may be a deterioration in manufacturability. Therefore, in the case where Co is contained, the Co content is set to be 0.01% or more and 0.3% or less.

One, two, or more selected from among V: 0.01% or more and 0.25% or less, Ti: 0.001% or more and 0.015% or less, Nb: 0.001% or more and 0.030% or less, Mg: 0.0002% or more and 0.0050% or less, B: 0.0002% or more and 0.0050% or less, and REM: 0.01% or more and 0.10% or less V: 0.010 or more and 0.25% or less V decreases the amounts of a solid solute C and a solid solute N by fixing C and N in steel in the form of precipitates. With this, since there is an increase in average r value, there is an increase in formability. Moreover, V is effective for decreasing the degree of non-homogeneous hardness distribution of a material, because it prevents the excessive hardening of martensite by inhibiting C from being excessively concentrated in martensite formed in a hot-rolled-sheet annealing process.

In order to obtain such effects, the V content is set to be 0.01% or more. On the other hand, in the case where the V content is more than 0.25%, there is a deterioration in formability, and there may be an increase in manufacturing costs. Therefore, in the case where V is contained, the V content is set to be 0.01% or more and 0.25% or less, preferably 0.02% or more and 0.15% or less, or more preferably 0.03% or more and 0.10% or less.

Ti: 0.001% or more and 0.015% or less and Nb: 0.001% or more and 0.030% or less

Ti and Nb, which are, like V, chemical elements having a high affinity for C and N, are effective for improving workability after a finish annealing process by decreasing the amounts of a solid solute C and a solid solute N in a parent phase as a result of being precipitated in the form of carbides and nitrides in a hot rolling process. In order to obtain such an effect, it is necessary that the Ti content be 0.001% or more or that the Nb content be 0.001% or more. In the case where the Ti content is more than 0.015% or where the Nb content is more than 0.030%, there is a case where it is not possible to achieve good surface quality due to an excessive amount of TiN or NbC precipitated. Therefore, in the case where Ti is contained, the Ti content is set to be 0.001% or more and 0.015% or less, and in the case where Nb is contained, the Nb content is set to be 0.001% or more and 0.030% or less. Ti content is preferably 0.003% or more and 0.010% or less, Nb content is preferably 0.005% or more and 0.020% or less, or more preferably 0.010% or more and 0.015% or less.

Mg: 0.0002% or more and 0.0050% or less

Mg is a chemical element which has the effect of improving hot workability. In order to obtain such an effect, it is necessary that the Mg content be 0.0002% or more. However, in the case where the Mg content is more than 0.0050%, there may be a deterioration in surface quality. Therefore, in the case where Mg is added, the Mg content is set to be 0.0002% or more and 0.0050% or less, preferably 0.0005% or more and 0.0030% or less, or more preferably 0.0005% or more and 0.0010% or less.

B: 0.0002% or more and 0.0050% or less.

B is a chemical element which is effective for preventing secondary cold work embrittlement. In order to obtain such an effect, it is necessary that the B content be 0.0002% or more. However, in the case where the B content is more than 0.0050%, there may be a deterioration in hot workability. Therefore, in the case where B is contained, the B content is set to be 0.0002% or more and 0.0050% or less, preferably 0.0005% or more and 0.0030% or less, or more preferably 0.0005% or more and 0.0010% or less.

REM: 0.01% or more and 0.10% or less

REM is a chemical element which improves oxidation resistance and which, in particular, improves the corrosion resistance of a weld zone by inhibiting the formation of an oxide film in the weld zone. In order to obtain such effects, it is necessary that the REM content be 0.01% or more. However, in the case where the REM content is more than 0.10%, there may be a deterioration in manufacturability, for example, a decrease in descaling capability against scale generated in a cold-rolled-sheet annealing process. In addition, since REM is an expensive chemical element, it is not preferable that the REM content be excessively large, because there is an increase in manufacturing costs. Therefore, in the case where REM is contained, the REM content is set to be 0.01% or more and 0.10% or less.

Hereafter, the metallographic structure of the cold-rolled ferritic stainless steel sheet according to aspects of the present invention will be described.

The metallographic structure of the cold-rolled ferritic stainless steel sheet should include a single ferrite phase. Moreover, the average grain diameter of the ferrite phase is set to be 10 μm or less. By forming such a metallographic structure, it is possible to decrease the degree of surface roughening induced by irregularities caused by crystal grains having a large grain diameter. In order to form such a microstructure, it is necessary to form a microstructure in which there are a large amount of lattice defects, which have a function of recrystallization sites, before a cold-rolled-sheet annealing process, that is, a microstructure in which there are a large amount of dislocations and in which the difference in crystal orientation between crystal grains adjacent to each other is large before a cold-rolled-sheet annealing process. Since the hardness of metal generally increases with an increase in the amount of dislocations, by generating a large amount of dislocations before a cold-rolled-sheet annealing process as is the case with aspects of the present invention, the deformation of the surface of a steel sheet in a cold rolling process is inhibited due to a decrease in deformation capability before a cold-rolled-sheet annealing process so that it is possible to decrease the degree of rolling-induced defects such as oil pits and flaws generated by the transfer of the polishing marks of rolls, which contributes to an improvement in gloss.

Moreover, the state in which the difference in crystal orientation between crystal grains adjacent to each other is large is a state in which ferrite grains have random plane orientations, that is, a state in which ferrite colonies (aggregates of ferrite grains having similar crystal orientations) are destroyed. In the case where ferrite colonies are destroyed before a cold-rolled-sheet annealing process and where recrystallization progresses in the cold-rolled-sheet annealing process, the ferrite grains adjacent to each other have further randomized plane orientations. Therefore, deformation occurs in an isotropic manner when stress is applied, which results in a decrease in the degree of surface irregularities such as ridging and roping, which occur in a direction parallel to the rolling direction.

Since the effects described above are obtained in the case where the average grain diameter of a ferrite phase is 10 μm or less, the upper limit of the range of the average grain diameter is set to be 10 μm. Here, in the case where the average grain diameter is more than 10 μm, grain growth totally progresses, or a microstructure including ferrite grains having a large grain diameter is formed, which results in the occurrence of surface roughening induced by irregularities caused by crystal grains having a large grain diameter, and which promotes the occurrence of ridging and roping.

Here, from the results of investigations, it was found that, in the case where the average grain diameter of a ferrite phase after a cold-rolled-sheet annealing process is in the range of 10 μm or less and where all the ferrite grains have a grain diameter in a similar grain diameter range, there is a deterioration in formability such as elongation and r value while there is an increase in strength. The present inventors conducted additional investigations in order to solve this problem, and, as a result, found that including grains which have grown to some extent is effective.

It is important to achieve sufficient ductility and deformation capability by including ferrite grains having a grain diameter which is large to some extent on the assumption that the average grain diameter is 10 μm or less. However, in the case where there are grains having a grain diameter of larger than 40 μm, since such grains are naturally surrounded by ferrite grains having a small grain diameter on the assumption that the average grain diameter is 10 μm or less, a so-called mixed-grain microstructure is formed, which results in a deterioration in surface roughening resistance. Therefore, it is not preferable that ferrite grains having a grain diameter of 40 μm or more be mixed. On the other hand, in the case where there is an increase in the amount of ferrite grains having a grain diameter of 10 μm or less, there is a case where it is not possible to achieve ductility necessary when, for example, deep drawing or bending work is performed. Therefore, it is necessary that the metallographic structure include mainly a ferrite phase having a grain diameter of 10 μm or more and less than 40 μm. In order to achieve sufficient formability, it is necessary that the proportion of ferrite grains having a grain diameter of 10 μm or more and less than 40 μm to the whole metallographic structure be 60% or more in terms of area ratio. It is preferable that ferrite grains having a grain diameter of 10 μm to 20 μm be included in an amount of 60% to 80% from the viewpoint of achieving better formability and aesthetic surface appearance quality at the same time.

Moreover, on condition that the ferrite grains having a grain diameter of 10 μm or more are included, in order to avoid the formation of mixed-grain microstructure which has a negative effect on surface roughening resistance (in which ferrite grains respectively having a large grain diameter and a small grain diameter coexist in a polarized manner), it is necessary that the proportion of a very fine ferrite phase having a grain diameter of less than 5 μm to the whole metallographic structure be less than 20% in terms of area ratio. In the case of a metallographic structure in which ferrite grains having a grain diameter of less than 5 μm are included in an amount of 20% or more and in which ferrite grains having a grain diameter of 10 μm or more are mainly included, surface roughening occurs due to the formation of a mixed-grain microstructure in which grain diameter distribution is polarized, and there is a deterioration in formability. It is preferable that ferrite grains having a grain diameter of less than 5 μm be included in an amount of less than 15% from the viewpoint of achieving a smoother surface and sufficient formability.

As described above, in the case of the metallographic structure of the cold-rolled ferritic stainless steel sheet according to aspects of the present invention, it is important that, on the assumption that the average grain diameter of a ferrite phase is 10 μm or less, both of the condition that the proportion of ferrite grains having a grain diameter of 10 μm or more and less than 40 μm to the whole metallographic structure is 60% or more in terms of area ratio and the condition that the proportion of ferrite grains having a grain diameter of less than 5 μm to the whole metallographic structure is less than 20% in terms of area ratio be satisfied.

Although there is no particular limitation on the grain diameter of the remaining ferrite grains which are out of the ranges described above, it is preferable that the grain diameter of the remaining ferrite grains be in the range of 5 μm or more and less than 10 μm. In addition, the remainder which is different from a ferrite phase is inevitable precipitates and inclusions.

Hereafter, an example of a method for manufacturing the cold-rolled ferritic stainless steel sheet according to aspects of the present invention will be described.

By preparing molten steel having the chemical composition described above by using a known method such as one using a converter, an electric furnace, or a vacuum melting furnace, and by then using a continuous casting method or an ingot casting-slabbing method, a steel material (slab) is obtained. By performing hot rolling on the slab after having heated the slab to a temperature of 1100° C. to 1250° C. or by performing hot rolling on the slab as cast without heating, a hot-rolled steel sheet is obtained. In the hot rolling process, by completing finish rolling in a dual-phase temperature range in which a ferrite phase and an austenite phase are formed, a hot-rolled steel sheet is obtained. Subsequently, when the steel sheet is coiled, the coiling temperature is 550° C. to 850° C., or preferably 600° C. to 700° C. With this, it is possible to facilitate the control of grain diameter and recrystallization of a ferrite phase in a continuous hot-rolled-sheet annealing process which is completed in a short time.

Subsequently, the hot-rolled steel sheet is subjected to hot-rolled-sheet annealing in which the steel sheet is held at a temperature of 900° C. or higher and 1050° C. or lower, that is, in a dual-phase temperature range in which a ferrite phase and an austenite phase are formed, for 10 seconds or more and 2 minutes or less. Such a method is effective for controlling the grain diameter of a ferrite phase of a cold-rolled steel sheet, which is a final product. By forming a martensite phase by performing this hot-rolled-sheet annealing, it is possible to obtain the effect of destroying ferrite colonies (aggregates of ferrite grains having similar crystal orientations) which are formed in a hot rolling process, and it is possible to form a metallographic structure having a plane orientation distribution more random than usual after a cold rolling process and a cold-rolled-sheet annealing process. In addition, since it is possible to control ferrite grain diameter before a cold rolling process by performing continuous annealing for a short time and at a high temperature in a hot-rolled-sheet annealing process, it is possible to facilitate the control for forming the desired ferrite grains in the final product (cold-rolled steel sheet) after a cold-rolled-sheet annealing process. Here, in the case where the annealing temperature of a hot-rolled-sheet annealing process is lower than 900° C. or where the annealing time of a hot-rolled-sheet annealing process is less than 10 seconds, since ferrite colonies are retained due to an insufficient amount of martensite being formed, the average grain diameter of a ferrite phase is beyond the range according to aspects of the present invention, which results in a deterioration in ridging resistance and roping resistance. Also, there is an increase in ferrite grain diameter after a cold-rolled-sheet annealing process, which has a negative effect on gloss and surface roughening resistance. In the case where the annealing temperature of a hot-rolled-sheet annealing process is higher than 1050° C. or in the case of long-time annealing where the annealing time of a hot-rolled-sheet annealing process is more than 2 minutes, since grain growth excessively progresses, there is an increase in the grain size of a ferrite phase. In addition, since there is an increase in the amount of a martensite phase formed, the area ratio of ferrite grains having a grain diameter of less than 5 μm becomes beyond the range according to aspects of the present invention due to an excessive increase in the amount of fine ferrite grains formed through the decomposition of a martensite phase in a cold-rolled-sheet annealing process, which makes it impossible to achieve specified formability, glossiness, or surface roughening resistance, and which results in a deterioration in elongation and r value. For these reasons, hot-rolled-sheet annealing should be performed at a temperature of 900° C. or higher and 1050° C. or lower for 10 seconds or more and 2 minutes or less, or preferably at a temperature of 910° C. or higher and 935° C. or lower for 15 seconds or more and 60 seconds or less.

Descaling is performed as needed by performing pickling or mechanical descaling. However, there is no particular limitation on what method is used.

Subsequently, cold rolling is performed. Any one of a tandem mill and a cluster mill may be used. Although there is no particular limitation on total rolling reduction of cold rolling in accordance with aspects of the present invention, it is preferable that the total rolling reduction of cold rolling be 50% or more from the viewpoint of formability and shape correction.

Subsequently, cold-rolled-sheet annealing is performed. It is necessary that cold-rolled-sheet annealing be performed in a ferrite-single-phase temperature range so that the final product has a ferrite single-phase structure. In addition, it is preferable that cold-rolled-sheet annealing be performed at as high a temperature as possible in a ferrite-single-phase temperature range so that a steel sheet, which has been subjected to cold rolling while having a dual phase composed of a ferrite phase and a martensite phase, has a ferrite single phase structure. Therefore, the annealing temperature is set to be 800° C. or higher and 890° C. or lower, or preferably 850° C. or higher and 890° C. or lower. In the case where the annealing temperature is lower than 800° C., since a martensite phase is retained, there may be a deterioration in elongation. In addition, since the area ratio of ferrite grains having a grain diameter of less than 5 μm becomes beyond the range according to aspects of the present invention, and since the area ratio of ferrite grains having a grain diameter of 10 μm or more and less than 40 μm becomes below the range according to aspects of the present invention, it is not possible to achieve the specified formability or glossiness. In the case where the annealing temperature is higher than 890° C., since an austenite phase is newly formed, and since the martensite transformation of the austenite phase occurs in a cooling process, there may be a significant deterioration in formability. In addition, it is preferable that cold-rolled-sheet annealing be performed by using a continuous annealing method in order to improve manufacturability and in order to avoid excessive grain growth of recrystallized ferrite grains. In addition, the holding time is set to be 5 seconds to 120 seconds. Moreover, it is preferable that the holding time be 10 seconds to 60 seconds in order to achieve sufficient formability and in order to prevent the polarization of a grain diameter distribution, which deteriorates surface roughening resistance.

There is no particular limitation on surface finish, and appropriate surface finish may be selected from among, for example, No. 2B, BA, polishing, and dull finish. In order to provide desired surface roughness and in order to prevent stretcher strain, skin pass rolling should be performed with an elongation ratio of 0.3% to 1.0%.

EXAMPLE 1

Hereafter, aspects of the present invention will be described in more detail on the basis of examples.

The stainless steels having the chemical compositions given in Table 1 were made into slabs having a thickness of 250 mm by using a continuous casting method. After having heated these slabs to a temperature of 1200° C., hot-rolled steel sheets having a thickness of 3 mm were obtained by performing hot rolling. At this time, the temperature of the steel sheets on the exit side of the finish rolling mill was 900° C. to 980° C., and the coiling temperature was 600° C. to 800° C.

Subsequently, after having performed hot-rolled-sheet annealing on the hot-rolled steel sheets described above under the conditions given in Table 2, and having performed a shot blasting treatment on the surfaces of the steel sheets, descaling was performed by performing pickling with two kinds of solutions, that is, sulfuric acid and a mixed acid composed of nitric acid and hydrofluoric acid. After having performed cold rolling on the obtained hot-rolled and annealed steel sheets to a thickness of 0.8 mm, and having performed cold-rolled-sheet annealing under the conditions given in Table 2, skin pass rolling was performed with an elongation ratio of 0.3% to 0.9% in order to obtain final products.

The final products (cold-rolled ferritic stainless steel sheets), which had been subjected to cold-rolled-sheet annealing, obtained as described above were subjected to microstructure observation and performance evaluation by using the following methods.

Microstructure Observation

After having taken a test piece for microstructure observation from the central portion in the width direction of the steel sheet, having performed mirror polishing on the cross section in the rolling direction, and having etched the cross section with aqua regia, photographs were taken in 5 fields of view in the central portion in the thickness direction of the steel sheet by using an optical microscope at a magnification of 500 times. In the obtained microstructure photograph, white region was identified as a ferrite phase. The average grain diameter of a ferrite phase was defined as the average value of the grain diameters of the 5 fields of view calculated in accordance with JIS G 0551. In these 5 fields of view, ferrite grains were classified into ferrite grains having a grain diameter of less than 5 μm, ferrite grains having a grain diameter of 10 μm or more and less than 40 μm, and ferrite grains having a grain diameter of 40 μm or more, and the area ratio occupied by each of the classes was derived.

Here, the grain diameter of a ferrite phase was defined as the arithmetic average of the distance between grain boundaries in a direction parallel to the rolling direction and the distance between grain boundaries in the thickness direction, which were determined on the basis of the ferrite grains observed in the metallographic photograph of each of the fields of view.

(1) Formability Evaluation (1-1) Elongation After Fracture

A JIS No. 13B tensile test piece was taken from the central portion in the width direction of the steel sheet so that the tensile direction was at an angle of 90° to the rolling direction, and then a tensile test was performed in accordance with JIS Z 2241. A case where the elongation after fracture (El) in a direction at an angle of 90° to the rolling direction was 30% or more was judged as more than satisfactory (⊙), a case where the elongation after fracture was 25% or more was judged as satisfactory (○), and a case where the elongation after fracture was less than 25% was judged as unsatisfactory (x).

(1-2) Average r Value

Moreover, a JIS No. 13B tensile test pieces was taken from the same portion so that the tensile directions were at angles 0°, 45°, and 90° to the rolling direction, and then a tensile test was performed in accordance with JIS Z 2241. By giving a pre-strain of 15%, an r value in each of the directions was determined. A case where the average r value calculated by equation (1) below was 0.65 or more was judged as satisfactory (○), and a case where the average r value was less than 0.65 was judged as unsatisfactory (x).

$$r_{ave}=(r_0+r_{90}+2\times r_{45})/4 \quad (1)$$

(2) Surface Appearance Quality (2-1) Surface Gloss (Glossiness)

A test piece was taken from the central portion in the width direction of the steel sheet, and then glossiness was determined at two points each in directions at angles of 0° and 90° to the rolling direction by using the reflected energy) (Gs20°) of a light having an incidence angle of 20° in accordance with the prescription in JIS Z 8741. Then, on the basis of the average value of the determined values, a case where the glossiness was 950 or more was judged as a case of excellent gloss (○) and a case where the glossiness was less than 950 was judged as unsatisfactory (x). In addition, a case where the glossiness was more than 1000 was judged as more than excellent (⊙).

(2-2) Roping Resistance

A test piece was taken from the central portion in the width direction of the steel sheet, and then surface roughness in a direction at an angle of 90° to the rolling direction was determined in accordance with JIS B 0601-2001. A case where Rz was 0.2 μm or less was judged as satisfactory (○) and a case where Rz was more than 0.2 μm was judged as unsatisfactory (x).

(2-3) Ridging Resistance

A JIS No. 5 tensile test piece was taken from the central portion in the width direction of the steel sheet so that the tensile direction was at an angle of 0° to the rolling direction, then one side of the test piece was polished to #600 finish, and a pre-strain of 20% was given to the test piece by applying a uniaxial tensile stress in accordance with JIS Z 2241. Then waviness height in the polished surface in the middle of the parallel part of a test piece was determined in accordance with JIS B 0601-2001. A case where the waviness height was 2.5 μm or less was judged as satisfactory (○) and a case where the waviness height was more than 2.5 μm was judged as unsatisfactory (x). In addition, a case where the waviness height was less than 2.0 μm was judged as more than excellent (⊙).

(2-4) Surface Roughening Resistance

The test piece having been used for determining ridging resistance was used. Surface roughness in the polished surface in the middle of the parallel part of the test piece was determined in accordance with JIS B 0601-2001. A case where Ra was less than 0.2 μm was judged as satisfactory (○) and a case where Ra was 0.2 μm or more was judged as unsatisfactory (x).

The results of the evaluations described above are given along with the manufacturing conditions in Table 2.

TABLE 1

| | mass % | | | | | | | | | | |
|---|---|---|---|---|---|---|---|---|---|---|---|
| Steel Code | C | Si | Mn | P | S | Cr | Al | N | Ni | Other | Note |
| A | 0.02 | 0.15 | 0.51 | 0.02 | 0.002 | 16.3 | 0.002 | 0.03 | 0.2 | — | Example |
| B | 0.04 | 0.27 | 0.64 | 0.04 | 0.008 | 16.3 | 0.004 | 0.05 | 0.1 | V: 0.14 | Example |
| C | 0.02 | 0.17 | 0.49 | 0.02 | 0.009 | 17.7 | 0.028 | 0.04 | — | — | Example |
| D | 0.03 | 0.19 | 0.81 | 0.02 | 0.003 | 16.4 | 0.011 | 0.06 | 0.2 | Cu: 0.4 | Example |
| E | 0.03 | 0.23 | 0.83 | 0.03 | 0.005 | 16.5 | 0.005 | 0.02 | — | V: 0.16, Ti: 0.007 | Example |
| F | 0.02 | 0.25 | 0.88 | 0.03 | 0.004 | 16.7 | 0.008 | 0.05 | 0.1 | Mo: 0.4 | Example |
| G | 0.04 | 0.15 | 0.70 | 0.02 | 0.003 | 16.1 | 0.004 | 0.02 | 0.5 | Nb: 0.013, Mg: 0.0013 | Example |
| H | 0.02 | 0.14 | 0.85 | 0.03 | 0.004 | 16.5 | 0.005 | 0.03 | — | V: 0.13, B: 0.0018 | Example |
| I | 0.04 | 0.26 | 0.67 | 0.04 | 0.005 | 16.0 | 0.015 | 0.02 | — | Co: 0.13 | Example |
| J | 0.03 | 0.25 | 0.31 | 0.02 | 0.004 | 16.5 | 0.008 | 0.03 | 0.2 | REM: 0.04 | Example |
| K | 0.04 | 0.22 | 0.83 | 0.03 | 0.003 | 15.7 | 0.045 | 0.03 | — | — | Comparative Example |
| L | 0.03 | 0.26 | 0.76 | 0.03 | 0.003 | 18.3 | 0.033 | 0.04 | 0.2 | — | Comparative Example |
| M | 0.07 | 0.36 | 0.63 | 0.03 | 0.006 | 16.6 | 0.048 | 0.05 | — | — | Comparative Example |
| N | 0.004 | 0.27 | 0.91 | 0.04 | 0.005 | 16.2 | 0.021 | 0.06 | 0.3 | — | Comparative Example |
| O | 0.006 | 0.14 | 0.76 | 0.04 | 0.003 | 16.4 | 0.003 | 0.016 | 0.3 | — | Example |
| P | 0.005 | 0.15 | 0.82 | 0.03 | 0.002 | 16.2 | 0.001 | 0.006 | 0.2 | — | Example |
| Q | 0.014 | 0.18 | 0.84 | 0.02 | 0.002 | 16.3 | 0.003 | 0.005 | 0.1 | Ti: 0.011 | Example |
| R | 0.016 | 0.13 | 0.79 | 0.03 | 0.004 | 16.3 | 0.003 | 0.014 | 0.2 | V: 0.05, Nb: 0.022 | Example |

TABLE 2

| | | Hot-rolled-sheet Annealing | | Cold-rolled-sheet Annealing | | Average Ferrite Grain | Ferrite Grain Area Ratio (%) | | Formability | |
|---|---|---|---|---|---|---|---|---|---|---|
| No. | Steel Code | Temperature (° C.) | Time (s) | Temperature (° C.) | Time (s) | Diameter (μm) | Less than 5 μm | 10 μm to 40 μm | Elongation after fracture | Average r value |
| 1 | A | 935 | 37 | 865 | 29 | 7.2 | 10 | 83 | ○ | ○ |
| 2 | B | 914 | 28 | 844 | 23 | 6.8 | 16 | 72 | ○ | ○ |
| 3 | C | 942 | 15 | 857 | 25 | 7.8 | 13 | 75 | ○ | ○ |
| 4 | D | 900 | 24 | 883 | 41 | 9.8 | 12 | 77 | ○ | ○ |
| 5 | E | 916 | 36 | 860 | 23 | 7.8 | 8 | 83 | ○ | ○ |
| 6 | F | 902 | 26 | 864 | 21 | 7.8 | 12 | 80 | ○ | ○ |
| 7 | G | 923 | 19 | 862 | 34 | 8.8 | 14 | 66 | ○ | ○ |
| 8 | H | 910 | 28 | 861 | 26 | 8.1 | 9 | 78 | ○ | ○ |
| 9 | I | 933 | 17 | 862 | 22 | 6.8 | 9 | 88 | ○ | ○ |
| 10 | J | 904 | 13 | 857 | 29 | 9.7 | 11 | 77 | ○ | ○ |
| 11 | K | 917 | 18 | 862 | 32 | 10.5 | 11 | 72 | ○ | ○ |
| 12 | L | 932 | 46 | 863 | 26 | 8.3 | 18 | 59 | X | X |
| 13 | M | 938 | 23 | 856 | 27 | 5.2 | 31 | 47 | X | X |
| 14 | N | 909 | 28 | 859 | 28 | 10.8 | 5 | 92 | ○ | ○ |
| 15 | B | 846 | 19 | 884 | 27 | 13.1 | 2 | 93 | ○ | ○ |
| 16 | C | 1005 | 20 | 859 | 41 | 8.9 | 25 | 60 | X | X |
| 17 | A | 900 | 21 | 789 | 39 | 8.6 | 28 | 55 | X | ○ |
| 18 | O | 995 | 37 | 865 | 29 | 8.7 | 6 | 62 | ⊙ | ○ |
| 19 | P | 989 | 28 | 844 | 23 | 9.9 | 7 | 73 | ⊙ | ○ |
| 20 | Q | 1002 | 37 | 865 | 29 | 8.8 | 4 | 68 | ⊙ | ○ |
| 21 | R | 997 | 28 | 844 | 23 | 6.9 | 13 | 85 | ⊙ | ○ |

| No. | Glossiness | Roping Resistance | Ridging Resistance | Surface Roughening Resistance | Note |
|---|---|---|---|---|---|
| 1 | ⊙ | ○ | ⊙ | ○ | Example |
| 2 | ⊙ | ○ | ⊙ | ○ | Example |

TABLE 2-continued

| | | | | | |
|---|---|---|---|---|---|
| 3 | ○ | ○ | ⊙ | ○ | Example |
| 4 | ⊙ | ○ | ⊙ | ○ | Example |
| 5 | ⊙ | ○ | ⊙ | ○ | Example |
| 6 | ⊙ | ○ | ⊙ | ○ | Example |
| 7 | ⊙ | ○ | ⊙ | ○ | Example |
| 8 | ⊙ | ○ | ⊙ | ○ | Example |
| 9 | ⊙ | ○ | ⊙ | ○ | Example |
| 10 | ⊙ | ○ | ○ | ○ | Example |
| 11 | X | ○ | ⊙ | ○ | Comparative Example |
| 12 | X | ○ | ⊙ | ○ | Comparative Example |
| 13 | X | ○ | ⊙ | ○ | Comparative Example |
| 14 | ⊙ | X | ○ | X | Comparative Example |
| 15 | ○ | X | X | X | Comparative Example |
| 16 | X | ○ | ○ | X | Comparative Example |
| 17 | X | ○ | ○ | ○ | Comparative Example |
| 18 | ⊙ | ○ | ⊙ | ○ | Example |
| 19 | ⊙ | ○ | ○ | ○ | Example |
| 20 | ⊙ | ○ | ⊙ | ○ | Example |
| 21 | ⊙ | ○ | ⊙ | ○ | Example |

It is clarified that, in the case where the chemical composition of steel and the method of manufacturing steel are both within the ranges according to aspects of the present invention, it is possible to achieve sufficient formability (elongation after fracture and average r value) and excellent surface appearance quality.

In the case of No. 11 where the Cr content was below the range according to aspects of the present invention, since the average grain diameter of a ferrite phase was beyond the range according to aspects of the present invention, it was not possible to achieve the specified glossiness. In the case of No. 12 where the Cr content was beyond the range according to aspects of the present invention, since the area ratio of ferrite grains having a grain diameter of 10 μm or more and less than 40 μm was below the range according to aspects of the present invention, it was not possible to achieve the specified formability or glossiness.

In the case of No. 13 where the C content was beyond the range according to aspects of the present invention, since the area ratio of ferrite grains having a grain diameter of less than 5 μm was beyond the range according to aspects of the present invention, and since the area ratio of ferrite grains having a grain diameter of 10 μm or more and less than 40 μm was below the range according to aspects of the present invention, it was not possible to achieve the specified formability or glossiness.

In the case of No. 14 where the C content was below the range according to aspects of the present invention, since the average grain diameter of a ferrite phase was beyond the range according to aspects of the present invention, it was not possible to achieve the specified roping resistance or surface roughening resistance.

In the case of No. 15 where the hot-rolled-sheet annealing temperature was excessively low, since the average grain diameter of a ferrite phase was beyond the range according to aspects of the present invention, it was not possible to achieve the specified roping resistance, ridging resistance, or surface roughening resistance.

In the case of No. 16 where the hot-rolled-sheet annealing temperature was excessively high, since the area ratio of ferrite grains having a grain diameter of less than 5 μm was beyond the range according to aspects of the present invention, it was not possible to achieve the specified formability, glossiness, or surface roughening resistance.

In the case of No. 17 where the cold-rolled-sheet annealing temperature was excessively low, since the area ratio of ferrite grains having a grain diameter of less than 5 μm was beyond the range according to aspects of the present invention, and since the area ratio of ferrite grains having a grain diameter of 10 μm or more and less than 40 μm was below the range according to aspects of the present invention, it was not possible to achieve the specified formability or glossiness.

As described above, it is clarified that, by appropriately controlling the average diameter and diameter distribution of the grains of a specified ferrite phase, it is possible to obtain a cold-rolled ferritic stainless steel sheet having the specified formability and excellent surface quality.

The cold-rolled ferritic stainless steel sheet obtained by aspects of the present invention can preferably be used for products manufactured by performing press forming involving mainly drawing and in applications in which high surface appearance quality is required such as kitchen equipment and eating utensils.

The invention claimed is:

1. A cold-rolled ferritic stainless steel sheet having a chemical composition containing, by mass %, C: 0.005% or more and 0.05% or less, Si: 0.02% or more and 0.75% or less, Mn: 0.1% or more and 1.0% or less, P: 0.04% or less, S: 0.01% or less, Al: 0.001% or more and 0.10% or less, N: 0.005% or more and 0.06% or less, Cr: 16.0% or more and 18.0% or less, and the balance being Fe and inevitable impurities and a metallographic structure including a ferrite phase, wherein the average grain diameter of a ferrite phase is 10 μm or less, wherein the proportion of ferrite grains having a grain diameter of 10 μm or more and less than 40 μm to the whole metallographic structure is 60% or more in terms of area ratio, and wherein the proportion of ferrite grains having a grain diameter of less than 5 μm to the whole metallographic structure is less than 20% in terms of area ratio, and the cold-rolled ferritic stainless steel sheet fulfills the following:

an elongation after fracture in a direction at an angle of 90° to a rolling direction is 25% or more in accordance with Japanese Industrial Standard (JIS) Z 2241, an average r value calculated by equation (1) determined using a tensile test in accordance with JIS Z 2241 is 0.65 or more, $$r_{ave}=(r_0+r_{90}+2\times r_{45})/4 \quad (1),$$

where $r_{ave}$ denotes an average r value, $r_0$ denotes an r value in a direction parallel to the rolling direction, $r_{90}$ denotes an r value in a direction at a right angle to the rolling direction, and $r_{45}$ denotes an r value in a direction at an angle of 45° to the rolling direction, an average surface gloss of a central portion in a width direction of the steel sheet in directions at angles of 0° and 90° to the rolling direction determined by using reflected energy (Gs20°) of a light having an incidence angle of 20° in accordance with JIS Z 8741 is 950 or more, a roping resistance is surface roughness Rz of a surface of the steel sheet in a direction at an angle of 90° to the rolling direction in accordance with JIS B 0601-2001 is 0.2 μm or less, a ridging resistance is waviness height in a polished surface in a middle of a parallel part of the steel sheet in accordance with JIS B 0601-2001 is 2.5 μm or less, and a surface roughening resistance is surface roughness Ra in the polished surface in the middle of the parallel part of the steel sheet in accordance with JIS B 0601-2001 is less than 0.2 μm.

2. The cold-rolled ferritic stainless steel sheet according to claim 1, the chemical composition further containing, by mass %, one, two, or more selected from among Cu: 0.1% or more and 1.0% or less, Ni: 0.1% or more and 1.0% or less, Mo: 0.1% or more and 0.5% or less, and Co: 0.01% or more and 0.3% or less.

3. The cold-rolled ferritic stainless steel sheet according to claim 1, the chemical composition further containing, by mass %, one, two, or more selected from among V: 0.01% or more and 0.25% or less, Ti: 0.001% or more and 0.015% or less, Nb: 0.001% or more and 0.030% or less, Mg: 0.0002% or more and 0.0050% or less, B: 0.0002% or more and 0.0050% or less, and REM: 0.01% or more and 0.10% or less.

4. The cold-rolled ferritic stainless steel sheet according to claim 2, the chemical composition further containing, by mass %, one, two, or more selected from among V: 0.01% or more and 0.25% or less, Ti: 0.001% or more and 0.015% or less, Nb: 0.001% or more and 0.030% or less, Mg: 0.0002% or more and 0.0050% or less, B: 0.0002% or more and 0.0050% or less, and REM: 0.01% or more and 0.10% or less.

* * * * *